US011920505B2

(12) United States Patent
Rolandson

(10) Patent No.: US 11,920,505 B2
(45) Date of Patent: Mar. 5, 2024

(54) HEAT EXCHANGE MODULE

(71) Applicant: Volvo Car Corporation, Gothenburg (SE)

(72) Inventor: Ola Rolandson, Vänersnäs (SE)

(73) Assignee: Volvo Car Corporation, Gothenburg (SE)

( * ) Notice: Subject to any disclaimer, the term of this patent is extended or adjusted under 35 U.S.C. 154(b) by 0 days.

(21) Appl. No.: 18/128,610

(22) Filed: Mar. 30, 2023

(65) Prior Publication Data

US 2023/0321627 A1 Oct. 12, 2023

(30) Foreign Application Priority Data

Apr. 6, 2022 (EP) ..... 22166908

(51) Int. Cl.

| | |
|---|---|
| ***F28F 9/00*** | (2006.01) |
| ***F01N 3/02*** | (2006.01) |
| ***F28D 21/00*** | (2006.01) |
| ***F28F 1/12*** | (2006.01) |
| ***F28F 1/22*** | (2006.01) |
| ***F28F 1/32*** | (2006.01) |
| *F28D 7/16* | (2006.01) |

(52) U.S. Cl.

CPC ..... *F01N 3/0205* (2013.01); *F28D 21/0003* (2013.01); *F28F 1/126* (2013.01); *F28F 1/22* (2013.01); *F28F 1/32* (2013.01); *F01N 2240/02* (2013.01); *F28D 7/1615* (2013.01); *F28F 2275/04* (2013.01)

(58) Field of Classification Search

CPC .. F01N 3/0205; F01N 2240/02; F28D 1/0366; F28D 9/0062; F28F 3/025

See application file for complete search history.

(56) References Cited

U.S. PATENT DOCUMENTS

| | | | |
|---|---|---|---|
| 8,291,892 | B2 | 10/2012 | Herve et al. |
| 2016/0327348 | A1 | 11/2016 | Mitsuo et al. |

FOREIGN PATENT DOCUMENTS

| | | | | |
|---|---|---|---|---|
| JP | H11132688 | A | * | 5/1999 |
| KR | 100666927 | B1 | * | 1/2007 |
| SE | 355233 | B | | 4/1973 |

OTHER PUBLICATIONS

Machine translation of JP-H11132688-A, accessed Oct. 20, 2023. (Year: 2023).*

Sep. 1, 2022 European Search Report issued in corresponding EP Application No. 22166908.

* cited by examiner

*Primary Examiner* — Jonathan R Matthias

(74) *Attorney, Agent, or Firm* — Clements Bernard Walker; Christopher L. Bernard

(57) ABSTRACT

A heat exchange module including a corrugated top heat exchange substrate and a corrugated bottom heat exchange substrate, and tubes that extend in a width direction (W) between the top and bottom substrates in heat exchanging contact with ridges of the substrates. A top and a bottom casing member contacts the substrates and each has a transverse side wall with slits oriented in the transverse direction (T) and accommodating the tubes. The side walls of the top and bottom casing members overlap and are mutually connected by soldering or brazing.

11 Claims, 4 Drawing Sheets

HEAT EXCHANGE MODULE

CROSS-REFERENCE TO RELATED APPLICATION

The disclosure claims the benefit of priority of co-pending European Patent Application No. 22166908.8, filed on Apr. 6, 2022, and entitled "Heat Exchange Module," the contents of which are incorporated in full by reference herein.

TECHNICAL FIELD

The disclosure relates to a heat exchange module including a corrugated top heat exchange substrate and a corrugated bottom heat exchange substrate, the substrates being spaced apart in a transverse direction, each substrate having ridges and channels that extend in a length direction, the channels and ridges of the top substrate extending parallel to the channels and ridges of the bottom substrate. The disclosure also relates to an assembly of such heat exchange modules, to a catalyst/steam reforming assembly in a vehicle with an internal combustion engine (ICE), and to a vehicle with an internal combustion engine including such a catalyst/steam reforming assembly.

BACKGROUND

Fuel Reforming technology that uses the heat available in the exhaust to upgrade ethanol fuel to a higher energy level hydrogen fuel is applied in the combustion engines with higher thermal efficiency for the ICE as a result.

To manufacture the heat exchanger with different pressures and tightness requirements for the two sides is a challenge.

Another challenge is to stack and assemble the components in the correct position for a rapid and reliable automated process of welding or soldering of the pipes.

A third challenge is to manage the thermal expansion on both sides of the heat exchanger without introducing tension that may lead to cracks.

It is an object to solve these issues and to provide a heat exchange module that enables cheaper automatic production in higher volumes. It is also an object to provide a heat exchanger that can accommodate thermal expansion and contraction that occurs in process involving temperatures above 4000C that are subject to rapid variations, so that it can be used in the high temperature process of steam reforming and that has good tightness properties for H2. The heat exchanger should be compact and sturdy so that it is suitable for automotive applications.

Furthermore, the heat exchanger should be easily adaptable to provide the required capacity. It is again an object to provide a vehicle with an internal combustion engine (ICE) having an ethanol fuel reformer including one or more heat exchanger modules according to the disclosure.

SUMMARY

A heat exchange module according to the disclosure includes tubes extending in a width direction between the top and bottom substrates, in heat exchanging contact with the ridges, the width direction being oriented transversely to the length direction of the channels and the ridges, from an inflow side to an outflow side, a top and a bottom casing member including casing surfaces adjacent the top and bottom substrates and having at the inflow and outflow sides a transverse side wall with slits oriented in the transverse direction and accommodating the tubes, the side walls of the top and bottom casing members overlapping and being mutually connected by soldering or brazing.

The tubes can accommodate thermal expansion and contraction while maintaining fluid tightness.

The tubes are maintained clamped between the top and bottom corrugated substrates and can freely mover relative to the substrates so that thermal expansion and contraction of the different components is allowed while maintaining good heat transfer contact.

The tubes maintain secure fluid tightness at high and varying temperatures and pressures. This makes the module suitable for use in an ethanol steam reformer, to operate at temperatures between 400° C. and 1000° C.

The slits in the casing side walls, which may be formed of sheet metal, receive the tubes in a high-speed automated assembly process, and align the tubes in accurately defined positions. The slits can effectively be sealed by welding or soldering to seal the passage of each tube through the side wall.

The overlapping side walls of the casing members result in gas-tight connection by welding or soldering.

The modules according to the disclosure can be stacked and combined to form a heat transfer unit that is suited for specific applications, such as a combined three-way catalyst and steam reforming unit for ethanol for use in vehicles including an internal combustion engine.

Substrates may be connected to a casing member along a casing side edge that is situated along a lower part of a respective casing side wall.

By welding or brazing the substrates along their edges to the side walls of the casing, a strong and reliable interconnection is obtained allowing sufficient relative movement between the casing and the substrate for accommodating thermal expansion while maintaining a defined position.

The tubes at the position of the transverse side walls may have a straight section extending in the width direction, transversely to the side walls.

The straight end parts of the tubes allow strong and fluid tight connection of the tube exterior to the slits in the side walls, which is particularly suitable in cases the heat exchange module is used in applications in which hydrogen is present in the module.

The slits in the side walls can include at their free end a V-shaped receiving part for guiding of the tubes upon placement of the tubes in the slits.

The V-shaped receiving part centers the tubes on placing in the slits and facilitates automated positioning and welding/brazing at high speeds.

The tubes may extend along an undulating trajectory with undulations in the width direction.

The undulating path of the tubes causes turbulence in the gases flowing over and under the tubes in crossflow, and results in improved heat transfer.

The undulating trajectory includes bend parts at a distance from a line that is parallel to the width direction, a distance of the two adjacent undulations being between 1.5 and 5 times a width of a channel.

The dimensions of the undulations in the pipe allow specific tailoring of the contact area for heat transfer between the pipe and the corrugated substrates. A larger area towards the gases flowing through the channels may balance the inner surface area that is in contact with the contents of the tubes. This ratio can be established using tests or CFD to work at peak efficiency for both sides of the heat exchanger.

The position of the ridges of the upper substrate in the width direction may correspond to the position of the channels of the lower substrate.

The tubes are firmly clamped between the ridges of the upper and lower substrate for obtaining good positioning and heat transfer while allowing sufficient relative movement for accommodating thermally induced movements.

The substrates may be coated with a platinum group metal.

In addition to the substrates, that may act as a three-way catalyst (TWC), the tubes may be coated with a platinum-group metal (PGM) to activate the reforming process. The coating of the tubes may have a different specification of PGM than the TWC substrate.

The modules of the disclosure can be formed into an assembly of at least two modules stacked on top of each other, the bottom surface of the upper casing member being soldered or brazed to the top surface of the lower casing member.

A combined catalyst/steam reforming assembly may be formed, including a heat exchange module according to disclosure, exhaust gases being led through the channels and ethanol and steam through the tubes.

A vehicle is provided including an internal combustion engine with cylinders that are connected to a fuel inlet and to an exhaust outlet, the exhaust outlet being in fluid contact with a catalyst/steam reforming assembly, such that exhaust gases flow through the channels, an evaporator that is in heat exchanging contact with the exhaust gases, a water and ethanol supply unit flowing water and ethanol through the evaporator for forming water and ethanol steam, the water and ethanol steam being passed into the tubes, and a reformed fuel duct connected to an outflow side of the tubes and being connected to a fuel inlet of the cylinders.

The heat exchange module according to the disclosure provides a compact and stable combined catalyst/steam reforming unit for the treatment of exhaust gases and for forming $H_2$ from ethanol, such as from bio-fuel, in automotive applications.

BRIEF DESCRIPTION OF THE DRAWINGS

A heat exchange module according to the disclosure will, by way of non-limiting example, be described in detail with reference to the accompanying drawings. In the drawings.

DETAILED DESCRIPTION

Figure 1:
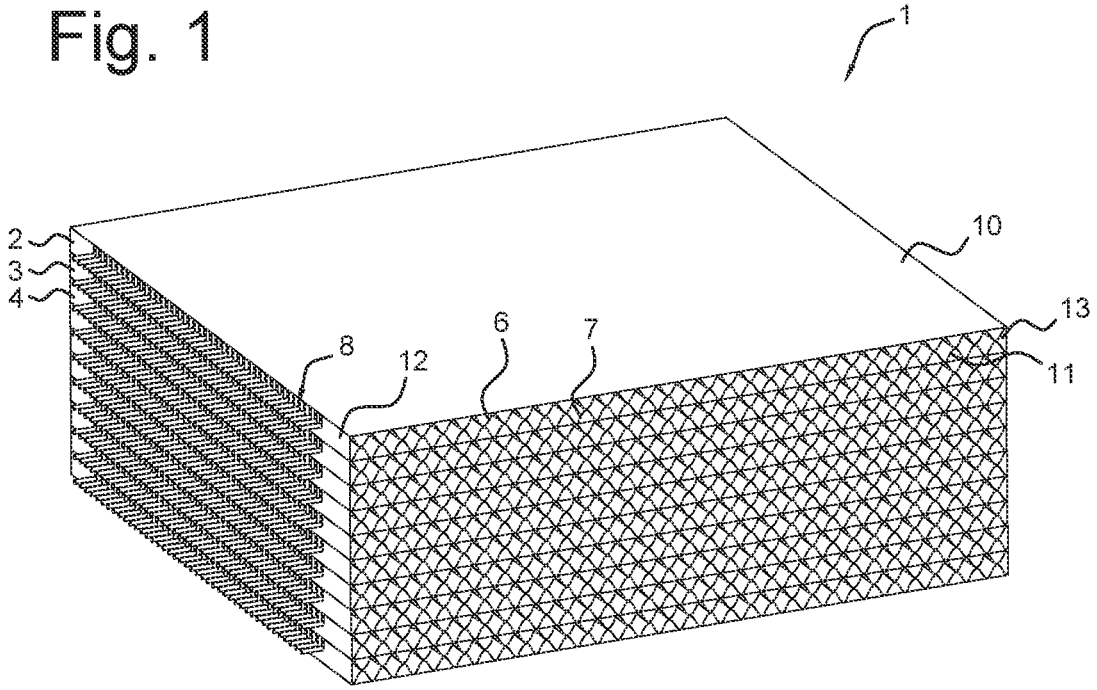
FIG. 1 shows a perspective view of a stack of heat exchange modules.

FIG. 1 shows a stack 1 of interconnected heat exchange modules 2, 3, 4, each module including two spaced-apart corrugated heat exchange substrates 6, 7 with tubes 8 extending in heat exchanging contacting relationship between the substrates. The substrates 6,7 and tubes 8 are encased between top and bottom casing members 10, 11, the casing members having overlapping side walls 12, 13 that are interconnected by brazing or soldering.

Figure 2:
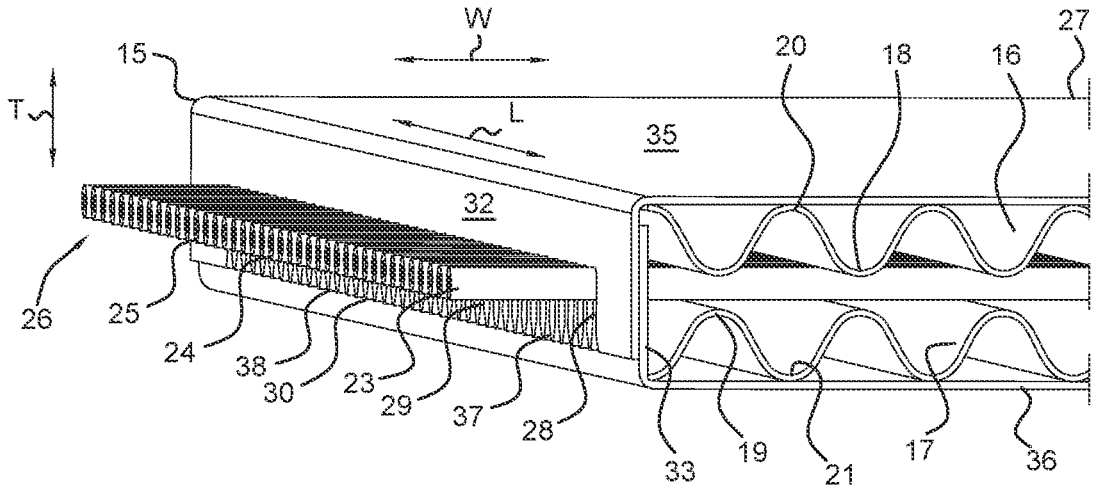
FIG. 2 shows a perspective view of a side section of a heat exchange module.

As can be seen in FIG. 2, the top and bottom heat exchange substrates 16,17 have ridges 19, 20 and channels 18, 21 that extend in the length direction Lather tubes 23, 24, 25 extend transversely to the ridges 19, 20 and channels 18, 21 in the width direction W from an inflow side 26 to an outflow side 27 and are clamped between the opposing ridges and channels 18, 19 of the top and bottom heat exchange substrates 16, 17. The tubes 23, 24, 25 pass through the slits 28, 29, 30 in the overlapping sidewalls 32, 33 of the casing members 35, 36. Each slit 28, 29, 30 has a V-shaped end part 37, 38 in which the tubes 23-26 are received and oriented during automated positioning. The tubes 23, 24, 25 are soldered into the slits 28-30 to form a gas-tight enclosure within the casing members 35, 36. The sidewalls 32, 33 are joined in a gas-tight manner by soldering in an overlapping position along their perimeter.

The heat exchange substrates 16,17 are brazed against the lower edges of the sidewall 33 so that the corrugated parts can slide with respect to the casing members 35, 36 while being kept firmly in place.

Figure 3:
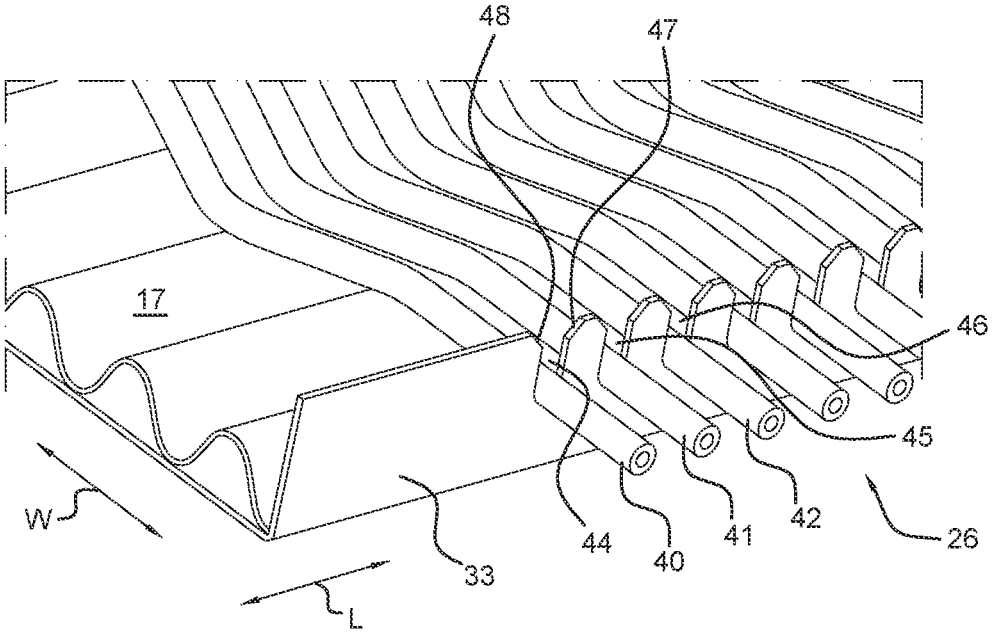
FIG. 3 shows a detail of tubes being received in slits in the sidewalls.

FIG. 3 shows a detail of the tubes 40,41,42 passing through the sidewall 33 via slits 44,45,46 with a V-shaped end part having slanting edges 47, 48. The tubes 40, 41, 42 extend along an undulating path in the width direction W in heat conducting contact with the heat exchange substrate 17. At the position of the sidewall 33, the tubes 8 extend along a straight line to allow easy handling upon insertion into the slits 44, 45, 46 and easy and accurate automated positioning.

Figure 4:
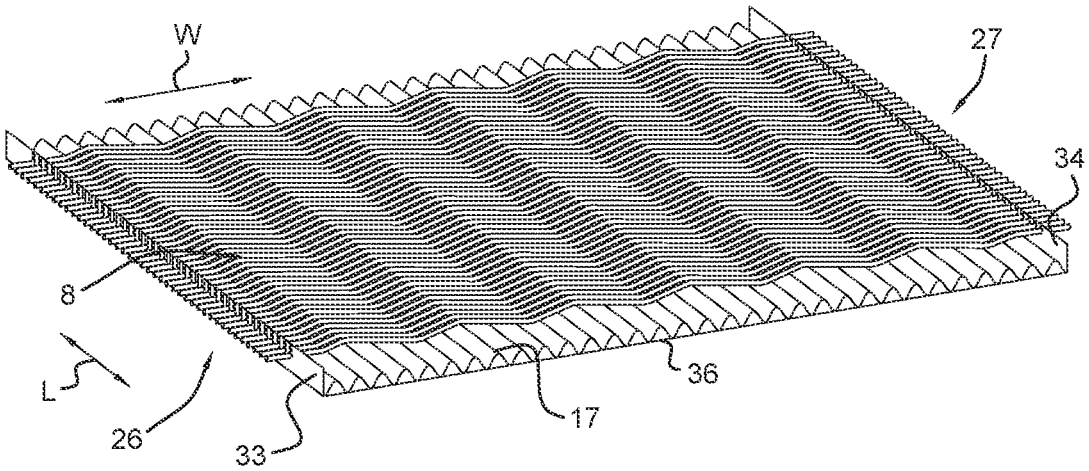
FIG. 4 shows a perspective view of the tubes and a bottom heat exchange substrate and casing member.

FIG. 4 shows a perspective view of the lower casing member 36 and heat exchange substrate 17, with the tubes 8 supported by the sidewalls 33, 34 and extending from an inflow side 26 to an outflow side 27. A number of 30-500 tubes may be accommodated in the arrangement shown. The undulating path of the tubes causes turbulence of the gases flowing in the length direction L, over and under the tubes, through the channels of the heat exchange substrates for improved heat transfer.

Figure 5:
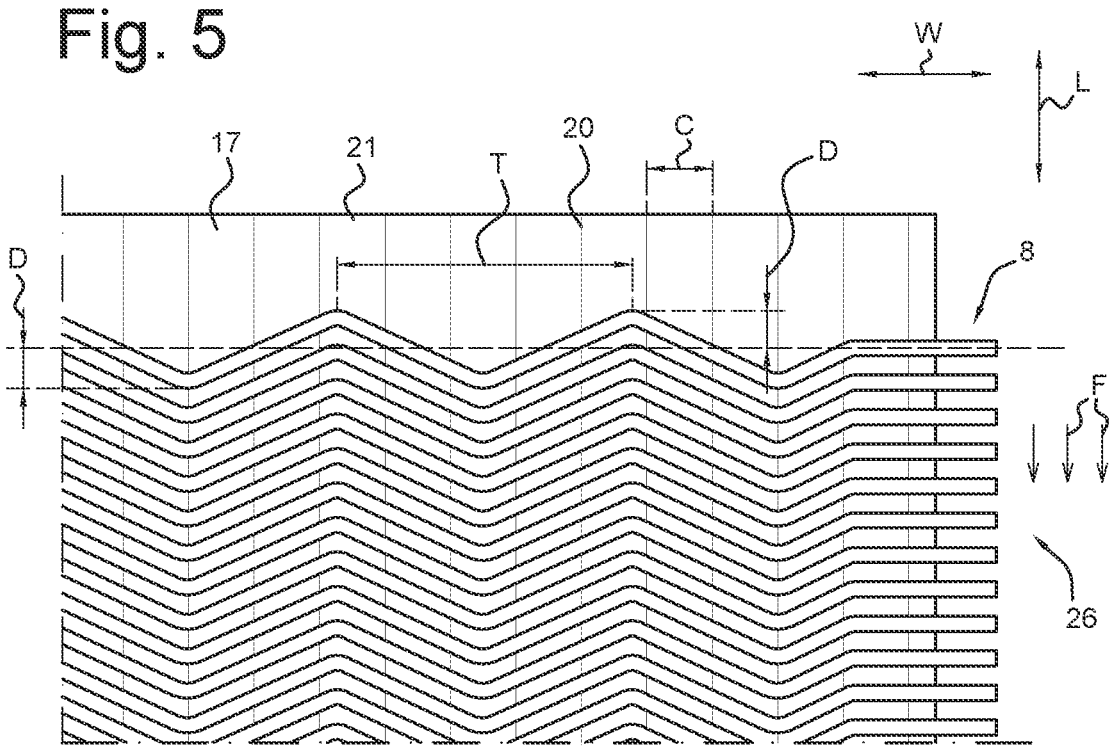
FIG. 5 shows a plan view of the tubes and the heat exchange substrate.

FIG. 5 shows the width C of the channels 20,21 and the amplitude D and period T of the undulating tubes 8. The values of C, D and T are carefully tuned to result in optimal heat transfer of gases flowing through the channels 20,21 in the direction F, and a fluid substance flowing through the tubes 8 in a crossflow manner. C:D: T may be about 1:1:5.

Figure 6:
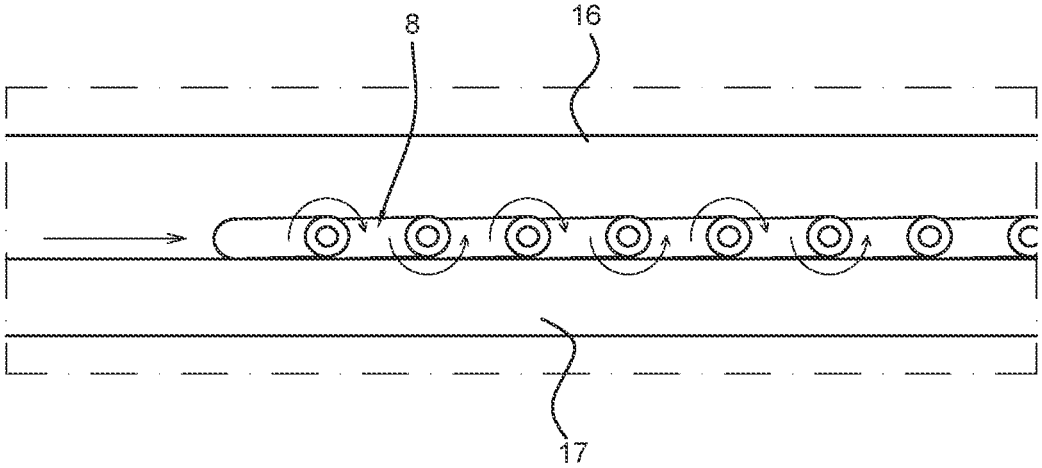
FIG. 6 shows the flow of gases around the tubes of the heat exchange module.

FIG. 6 shows the flow of gases flowing through the channels of the upper and lower heat exchange substrates 16, 17 while passing over and under the tubes 8. The turbulent flow pattern results in good heat exchange properties.

Figure 7:
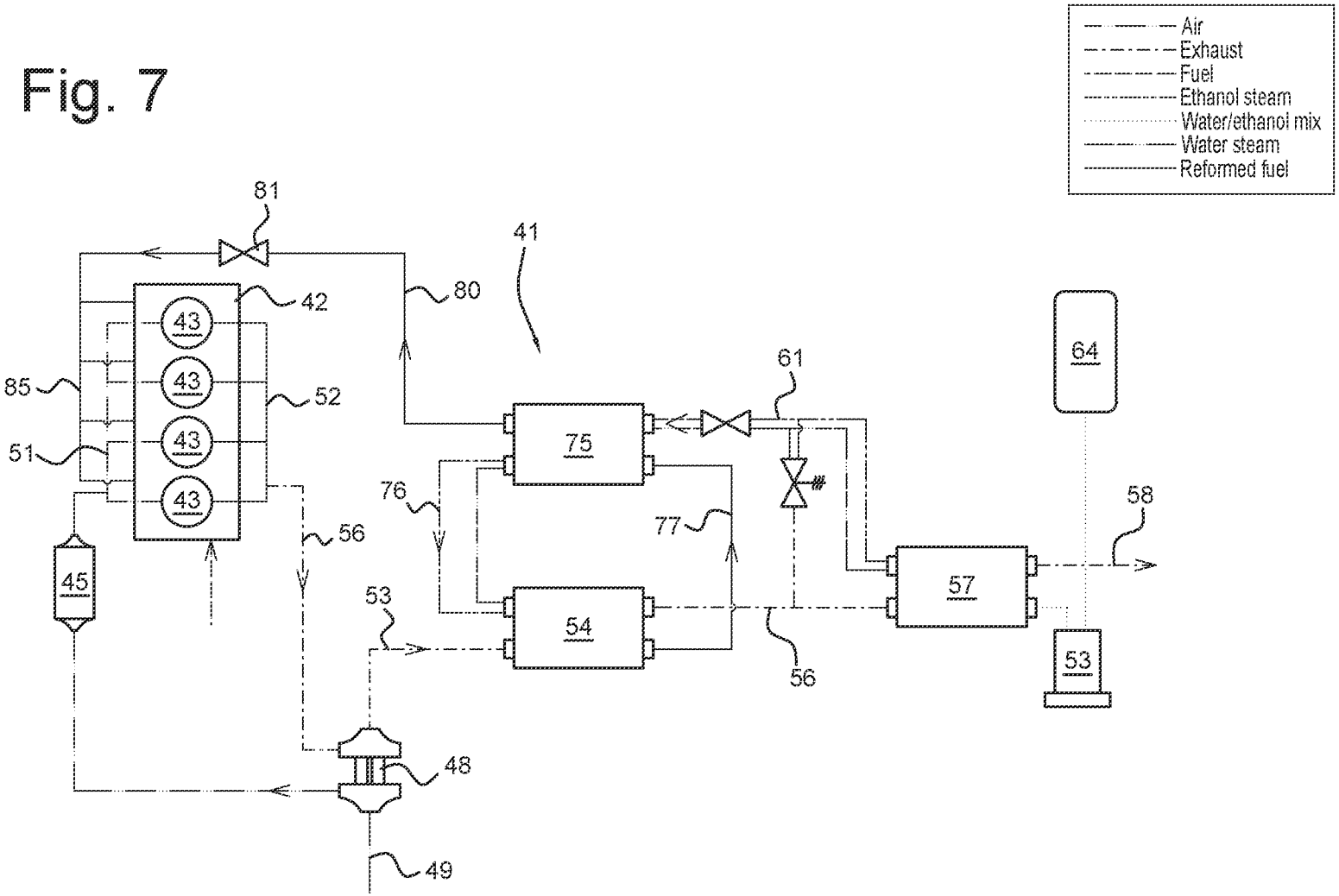
FIG. 7 shows an embodiment of a vehicle including an ethanol reforming unit including heat exchange modules according to the disclosure.

FIG. 7 shows an internal combustion engine assembly 41 with an internal combustion engine 42 having four cylinders 43. A fuel inlet 44 supplies a fuel, that may contain bio-ethanol, for instance in the form of an E10, to the cylinders 43.

A turbocharger 48 compresses the air that is supplied from an air intake 49 and transports the intake air through a cooler 45 to the intake manifold 51 for supply to the cylinders 43. The exhaust gases of the fuel that has been burned in the cylinders 43, leave the engine 42 via an exhaust manifold 52 and flow through an exhaust duct 56 to drive the turbocharger 48. After passing through the turbocharger 48, the exhaust gases flow via the duct 53 into an integrated catalytic converter/fuel reformer unit 54 that is formed from stacked heat exchange modules that are described in FIGS. 1 to 4. Via an exhaust duct 56, the exhaust gases pass to an ethanol evaporator 57 and from there via exhaust duct 58 to a tail pipe to be expelled into the ambient.

A pump 63 is connected to a water/ethanol tank 64 and supplies water and ethanol from the tank 64 to the evaporator 57 where the water/ethanol, that is at ambient temperature, is brought in heat exchanging contact with the exhaust gases. The ethanol steam and water steam that is produced in the evaporator 57, is supplied via a duct 61 to a pre-heater/cooler unit 75.

The pre-heated water steam and ethanol steam mixture is fed from the unit 75 to the integrated catalytic converter/fuel reformer unit 54 through duct 76, where the water and steam are flowing through the tubes 8 shown in FIGS. 1-4, of the reformer unit 54, to be reformed into syngas. The exhaust gases flow through the channels of the heat exchange substrates. The tubes 8 may be coated with a PGM to activate the reforming process. The coating of the tubes may have a different specification of PGM than the coating of the heat exchange substrate, that forms a TWC for the removal of NOx and hydrocarbons from the exhaust gases.

The exhaust gases flow from the duct 53 in the reformer unit 54 through the channels 20,21 of the top and bottom heat exchange substrates 6,7; 16,16 that are shown in FIGS. 1 and 2.

The syngas that is formed in the integrated catalytic converter/fuel reformer unit 54 is transported via a syngas outlet duct 77, through the pre-heater/cooler unit 75 and preheats the water and ethanol by being brought in heat exchanging contact with the water/ethanol steam that is supplied at the inlet of the unit 75.

Via an outlet duct 80 and a reduction valve 81, the syngas is supplied to a gas inlet manifold 85 that is connected to the cylinders 3.

The invention claimed is:

1. A heat exchange module comprising:

a corrugated top heat exchange substrate and a corrugated bottom heat exchange substrate, the substrates being spaced apart in a transverse direction (T), each substrate having ridges and channels that extend in a length direction (L), the channels and ridges of the top substrate extending parallel to the channels and ridges of the bottom substrate, tubes extending in a width direction (W) between the top and bottom substrates, in heat exchanging contact with the ridges, the width direction (W) being oriented transversely to the length direction (L) of the channels and the ridges, from an inflow side to an outflow side, a top and a bottom casing member comprising casing surfaces adjacent the top and bottom substrates and having at the inflow and outflow sides a transverse side wall with slits oriented in the transverse direction (T) and accommodating the tubes, the side walls of the top and bottom casing members overlapping and being mutually connected by soldering or brazing.

2. The heat exchange module according to claim 1, each substrate being connected to a casing member along a casing side edge that is situated along a lower part of a respective casing side wall.

3. The heat exchange module according to claim 1, the tubes at the position of the transverse side walls having a straight section extending in the width direction (W), transversely to the side walls.

4. The heat exchange module according to claim 1, the slits in the side walls comprising at their free end a V-shaped receiving part for guiding of the tubes upon placement of the tubes in the slits.

5. The heat exchange module according to claim 1, the tubes extending along an undulating trajectory with undulations in the width direction (W).

6. The heat exchange module according to claim 1, the undulating trajectory comprising bend parts at a distance (D) from a line that is parallel to the width direction (W), a distance (T) of the two adjacent undulations being between 1.5 and 5 times a width (C) of a channel.

7. The heat exchange module according to claim 1, the position of the ridges of the upper substrate in the width direction (W) corresponding to the position of the channels of the lower substrate.

8. The heat exchange module according to claim 1, the substrates being coated with a platinum group metal.

9. The heat exchange module according to claim 1, further comprising:

another heat exchange module comprising:

another corrugated top heat exchange substrate and another corrugated bottom heat exchange substrate, the substrates being spaced apart in a transverse direction (T), each substrate having ridges and channels that extend in a length direction (L), the channels and ridges of the top substrate extending parallel to the channels and ridges of the bottom substrate, other tubes extending in a width direction (W) between the top and bottom substrates, in heat exchanging contact with the ridges, the width direction (W) being oriented transversely to the length direction (L) of the channels and the ridges, from an inflow side to an outflow side, another top and another bottom casing member comprising casing surfaces adjacent the top and bottom substrates and having at the inflow and outflow sides a transverse side wall with slits oriented in the transverse direction (T) and accommodating the tubes, the side walls of the top and bottom casing members overlapping and being mutually connected by soldering or brazing, wherein the modules are stacked on top of each other, the bottom surface of the upper casing member being soldered or brazed to the top surface of the lower casing member.

10. A catalyst/steam reforming assembly comprising a heat exchange module comprising:

a corrugated top heat exchange substrate and a corrugated bottom heat exchange substrate, the substrates being spaced apart in a transverse direction (T), each substrate having ridges and channels that extend in a length direction (L), the channels and ridges of the top substrate extending parallel to the channels and ridges of the bottom substrate, tubes extending in a width direction (W) between the top and bottom substrates, in heat exchanging contact with the ridges, the width direction (W) being oriented transversely to the length direction (L) of the channels and the ridges, from an inflow side to an outflow side, a top and a bottom casing member comprising casing surfaces adjacent the top and bottom substrates and having at the inflow and outflow sides a transverse side wall with slits oriented in the transverse direction (T) and accommodating the tubes, the side walls of the top and bottom casing members overlapping and being mutually connected by soldering or brazing, exhaust gases being led through the channels and alcohol and steam through the tubes.

11. A vehicle comprising:

a combustion engine with cylinders that are connected to a fuel inlet and to an exhaust outlet, the exhaust outlet being in fluid contact with a catalyst/steam reforming assembly comprising a heat exchange module comprising:

a corrugated top heat exchange substrate and a corrugated bottom heat exchange substrate, the substrates being spaced apart in a transverse direction (T), each substrate having ridges and channels that extend in a length direction (L), the channels and ridges of the top substrate extending parallel to the channels and ridges of the bottom substrate, tubes extending in a width direction (W) between the top and bottom substrates, in heat exchanging contact with the ridges, the width direction (W) being oriented transversely to the length direction (L) of the channels and the ridges, from an inflow side to an outflow side, a top and a bottom casing member comprising casing surfaces adjacent the top and bottom substrates and having at the inflow and outflow sides a transverse side wall with slits oriented in the transverse direction (T) and accommodating the tubes, the side walls of the top and bottom casing members overlapping and being mutually connected by soldering or brazing, exhaust gases being led through the channels and alcohol and steam through the tubes, an evaporator that is in heat exchanging contact with the exhaust gases, a water and ethanol supply unit flowing water and ethanol through the evaporator for forming water and ethanol steam, the water and ethanol steam being passed into the tubes, and a reformed fuel duct connected to an outflow side of the tubes and being connected to a fuel inlet of the cylinders.

* * * * *